US006867759B1

(12) United States Patent
Baek et al.

(10) Patent No.: US 6,867,759 B1
(45) Date of Patent: Mar. 15, 2005

(54) LIQUID CRYSTAL DISPLAY AND DRIVING METHOD THEREOF

(75) Inventors: Jong Sang Baek, Kumi-shi (KR); Chang Gone Kim, Daegu-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 374 days.

(21) Appl. No.: 09/655,937

(22) Filed: Sep. 6, 2000

(30) Foreign Application Priority Data

Jun. 29, 2000 (KR) ..... 2000-36648

(51) Int. Cl.[7] ..... G09G 3/36
(52) U.S. Cl. ..... 345/99; 345/98
(58) Field of Search ..... 345/99, 98, 87, 345/123

(56) References Cited

U.S. PATENT DOCUMENTS 6,040,828 A * 3/2000 Park ..... 345/123
6,191,769 B1 * 2/2001 Fujiwara et al. ..... 345/99
6,211,850 B1 * 4/2001 Komatsu ..... 345/87
6,229,513 B1 * 5/2001 Nakano et al. ..... 345/99
6,323,836 B1 * 11/2001 Shin ..... 345/99
6,362,804 B1 * 3/2002 Park et al. ..... 345/99
2001/0003447 A1 * 6/2001 Murai et al. ..... 345/99

* cited by examiner

*Primary Examiner*—Amr A. Awad
*Assistant Examiner*—Alecia D. Nelson
(74) *Attorney, Agent, or Firm*—McKenna Long & Aldridge LLP

(57) ABSTRACT

A liquid crystal display device for restraining a generation of transient current is disclosed. In the device, a line memory divides a data for at least one line inputted from the exterior thereof into a plurality of groups to store the divided data therein and outputs the data at a desired unit from each of the groups. A driving circuit includes n driver integrated circuits (wherein n is an integer) that are connected to the line memory and a liquid crystal display panel to drive the liquid crystal display panel in response to the data outputted from the line memory. A timing controller is connected to the line memory and the driving circuit to receive a data clock inputted from the exterior thereof for outputting the data from the plurality of groups of said line memory to the driving circuit every period of the data clock in response to a time corresponding to the number of said groups.

32 Claims, 7 Drawing Sheets

LIQUID CRYSTAL DISPLAY AND DRIVING METHOD THEREOF

This application claims the benefit of Korean Patent Application No. 2000-36648, filed on Jun. 29, 2000, which is hereby incorporated by reference.

BACKGROUND OF THE INVENTION

1. Field of the Invention

The present invention relates to a liquid crystal display, and more particularly to a liquid crystal display device and a driving method thereof that is adaptive for restraining a generation of a transient current.

2. Discussion of the Related Art

Generally, a liquid crystal display device has an inherent resolution corresponding to the number of integrated pixels, and has a higher resolution as its dimension becomes larger. In order to display a high quality of picture, makers of the liquid crystal display device increase a pixel integration ratio within a liquid crystal panel between liquid crystal display devices with same dimension to differentiate the resolution.

In the liquid crystal display device, a data clock DCLK according to the XGA class data is 65 MHz on the basis of a refresh rate of 60 Hz. More specifically, in a system including a video card, a frequency of the data clock DCLK transferred to the liquid crystal display device is 65 MHz at a XGA resolution; 108 MHz at a SXGA resolution; and 160 MHz at a UXGA resolution.

In the liquid crystal display (LCD) as mentioned above, a frequency of an accepted input data clock of driver integrated circuits for displaying a data on a liquid crystal display panel is about 45 to 60 MHz. Accordingly, the recent liquid crystal display device divides input and output data in parallel so as to reduce a high data clock frequency and transfers the data simultaneously over a plurality of transmission lines, thereby reducing driving frequencies of the driver integrated circuits.

FIG. 1 is a block diagram showing a configuration of the conventional LCD, which illustrates a LCD having a XGA class resolution. In recent, in order to reduce a frequency of a driving clock in the LCD, a data for two pixels divided into odd and even pixel data is inputted, via an interface, from the system. Thus, a frequency of the data clock DCLK is 35.5 MHz lower than 65 MHz which is a data clock frequency of an original image signal.

Referring to FIG. 1, a timing controller 10 receives odd and even data and a data clock from an interface (not shown). The timing controller 10 is synchronized with the data clock to supply a data driving circuit 20 including n data driver IC's D1 to Dn with the odd and even data. Then, the data driving circuit 20 supplies a liquid crystal display panel 30 with the odd and even data. At this time, a gate driving circuit 40 including m gate driver IC's G1 to Gm is synchronized with the odd and even data so that the liquid crystal display panel 30 may display a picture, thereby applying a pulse signal to the liquid crystal display panel 30. The data driver IC's D1 to Dn receives a source sampling signal from the timing controller 10 to latch a data.

FIG. 2 is a timing chart showing a frequency-division concept of a data clock (DCLK) frequency. Referring to FIG. 2, an original data (b) for one pixel is outputted in synchronization with a data clock DCLK1 (a). Then, the system or the LCD latches the data (b) to synchronize an odd data (d) and even data (e) with twice-frequency-divided data clock DCLK (c) and output the same simultaneously. Such a driving method is referred to as "two-port port driving method" or "six-bus driving method" because the data (d) and (e) for two pixels are simultaneously outputted, which has been disclosed in Korea Patent Application No. 95-19513 filed on Jul. 4, 1995 by the same applicant.

However, the above-mentioned conventional LCD and driving method thereof reduces a driving frequency in the LCD, but increases a data amount outputted simultaneously according to an increase in a data output. For instance, in the case of a two-port driving method in the LCD using a 8-bit data, a data is simultaneously outputted, via 48 bit lines (i.e., 48 bit line=2(port)×3(R,G,B)×8(bit)), from the timing controller 10. At this time, a transient current is generated within the timing controller 10 in a conversion process between data (high/low).

Recently, a high-resolution LCD capable of a high-resolution picture in a same size of LCD has been required to display a high quality picture. For instance, a data clock frequency in a high-resolution UXGA system is about 160 MHz. An apparatus and method in FIG. 1 according to the conventional "two-port driving method" for reducing the data clock frequency is capable of reducing a data clock into about 80 MHz. Since the above-mentioned data clock is higher than an accepted input value in the general diver IC 's, however, a frequency reduction according to a high resolution has been more required. Accordingly, another conventional apparatus and method latches a data inputted with being divided into odd and even data one line by one line using a line memory and outputs 4 pixel data simultaneously according to a division of the panel area. Such a driving method may be referred to as "four-port driving method.

FIG. 3 is an operational timing chart according to the above-mentioned conventional four-port data transmission method. In FIG. 3, as an example, n driver IC 's connected to the liquid crystal display panel 30 are two-division driven into left and right groups as shown in FIG. 2. More specifically, data data1 to data1024 for one horizontal line inputted as shown in (b) and (c) in FIG. 3 are latched, and 4 pixel data are simultaneously outputted as shown in (e), (f), (g) and (h) in FIG. 3 upon inputting of the next horizontal line data. Accordingly, an input data clock (a) has a frequency reduced to ½ like a two frequency-divided source sampling clock SSC (d).

Assuming that an LCD according to the above-mentioned driving method uses a 8-bit data as an example, an output data line of the timing controller 10 becomes 4×3(R,G,B)×8(bit)=96 bit line. Thus, when the nth four data are converted and outputted to the (n+1)th four data, a transient current is generated within the timing controller 10. More specifically, when a data conversion of Low/High or High/Low is made, or when a plurality of data conversion of Low/High is made, a transient current flows in the timing controller 10.

Such a transient current shortens a life of the LCD and makes an adverse effect to devices such as a DC to DC converter (not shown) for a current supply, and generates an analog power noise, etc. Furthermore, the conventional LCD additionally requires a capacitor for eliminating the transient current to cause a complex configuration and a cost rise.

SUMMARY OF THE INVENTION

Accordingly, it is an object of the present invention to provide a liquid crystal display device wherein an output timing of a plurality of picture data in the LCD device is set differently to restrain a generation of transient current.

A further object of the present invention is to provide a driving method for an liquid crystal display device that is capable of reducing a generation of transient current according to a plurality of picture data output.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In order to achieve these and other objects of the invention, a liquid crystal display device according to an aspect of the present invention includes a line memory for dividing a data for at least one line inputted from the exterior thereof into a plurality of groups to store the divided data therein and for outputting the data at a desired unit from each of the groups; a driving circuit including n driver integrated circuits (wherein n is an integer) that are connected to the line memory and a liquid crystal display panel to drive the liquid crystal display panel in response to the data outputted from the line memory; and a timing controller, being connected to the line memory and the driving circuit, for receiving a data clock inputted from the exterior thereof to output the data from the plurality of groups of said line memory to the driving circuit every period of the data clock in response to a time corresponding to the number of said groups.

A liquid crystal display device according to another aspect of the present invention includes a line memory for dividing a data for at least one line inputted from the exterior thereof into a plurality of groups to store the divided data therein and for outputting the data at a desired unit from each of the groups; a driving circuit including n driver integrated circuits (wherein n is an integer) that are connected to the line memory and a liquid crystal display panel to drive the liquid crystal display panel in response to the data outputted from the line memory; and a timing controller, being connected to the line memory and the driving circuit, for receiving a data clock inputted from the exterior thereof to generate a first data clock by frequency-dividing the data clock at a frequency-division ratio corresponding to the number of said divided groups, and for outputting the data in each of the groups to the driving circuit during each period of the first data clock.

A liquid crystal display device according to still another aspect of the present invention includes a line memory for receiving two pixel data unit sequentially from the exterior thereof and dividing the data for at least one line into a plurality of groups to store the divided data therein and for outputting the two pixel data unit from each of the groups; a driving circuit including n driver integrated circuits (wherein n is an integer) that are connected to the line memory and a liquid crystal display panel to drive the liquid crystal display panel in response to the data outputted from the line memory; and a timing controller, being connected to the line memory and the driving circuit, for receiving a data clock inputted from the exterior thereof to generate a first data clock by frequency-dividing the data clock at a frequency-division ratio corresponding to the number of said divided groups, and for outputting the two pixel data in each of the groups to the driving circuit during each period of the first data clock.

A liquid crystal display device according to still another aspect of the present invention includes a latch circuit for latching and outputting two pixel unit inputted from the exterior thereof; a driving circuit including n driver integrated circuits (wherein n is an integer) that are connected to the latch circuit and a liquid crystal display panel to drive the liquid crystal display panel in response to the data outputted from the latch; and a timing controller, being connected to the latch circuit and the driving circuit, for receiving a data clock inputted from the exterior thereof to output each one pixel data to the driving circuit at a desired time interval during one period of the data clock.

A method of driving A liquid crystal display device according to still another aspect of the present invention includes a data storage step of dividing and storing an input data for at least one line a plurality of groups; a data clock generating step of frequency-dividing an input first data clock at a frequency-division ratio corresponding to the number of said divided groups to generate a second data clock; a data outputting step of outputting a desired data unit from each of said groups at a different time during one period of the second data clock; and a displaying step of latching the output data for one line unit to drive a liquid crystal display panel in response to the latched data.

It is to be understood that both the foregoing general description and the following detailed description are exemplary and explanatory and are intended to provide further explanation of the invention as claimed.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiment of the present invention, example of which is illustrated in the accompanying drawings.

Figure 1:
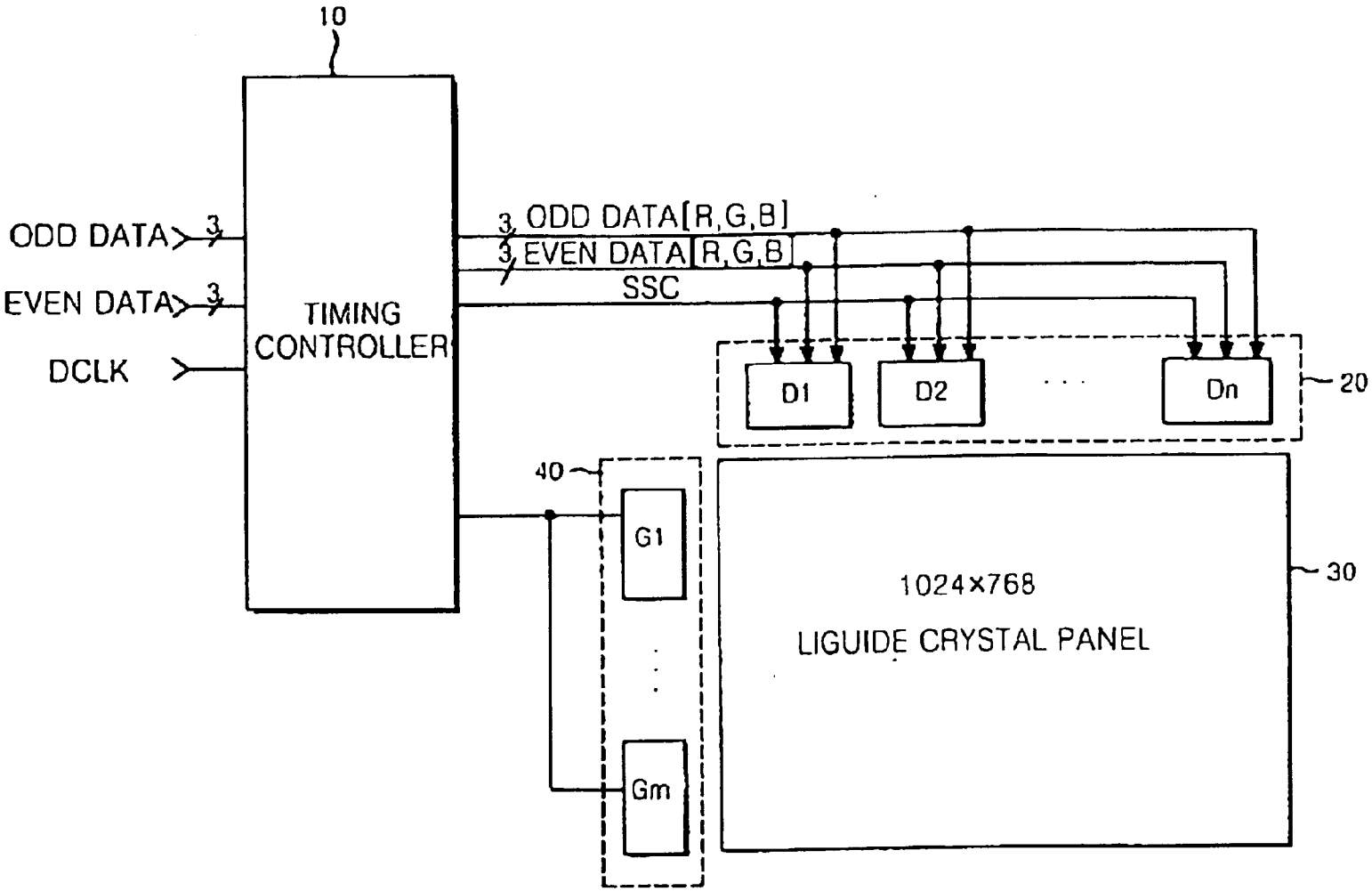
FIG.1 PRIOR ART
FIG. 1 is a block diagram showing a configuration of a general liquid crystal display device.
Figure 2:
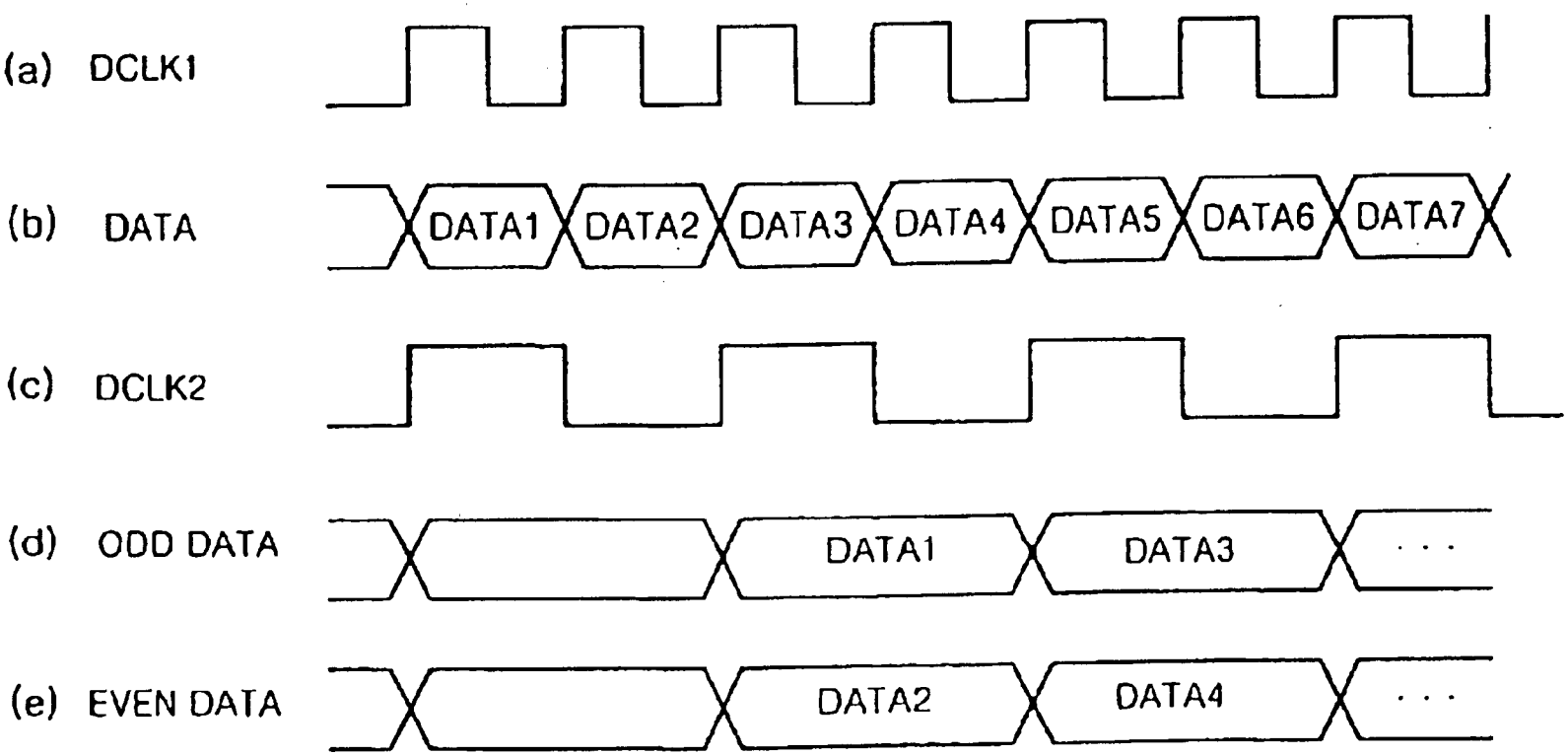
FIG. 2 PRIOR ART
FIG. 2 is an input and output timing chart of the liquid crystal display device of six-bus driving system shown in FIG. 1.
Figure 3:
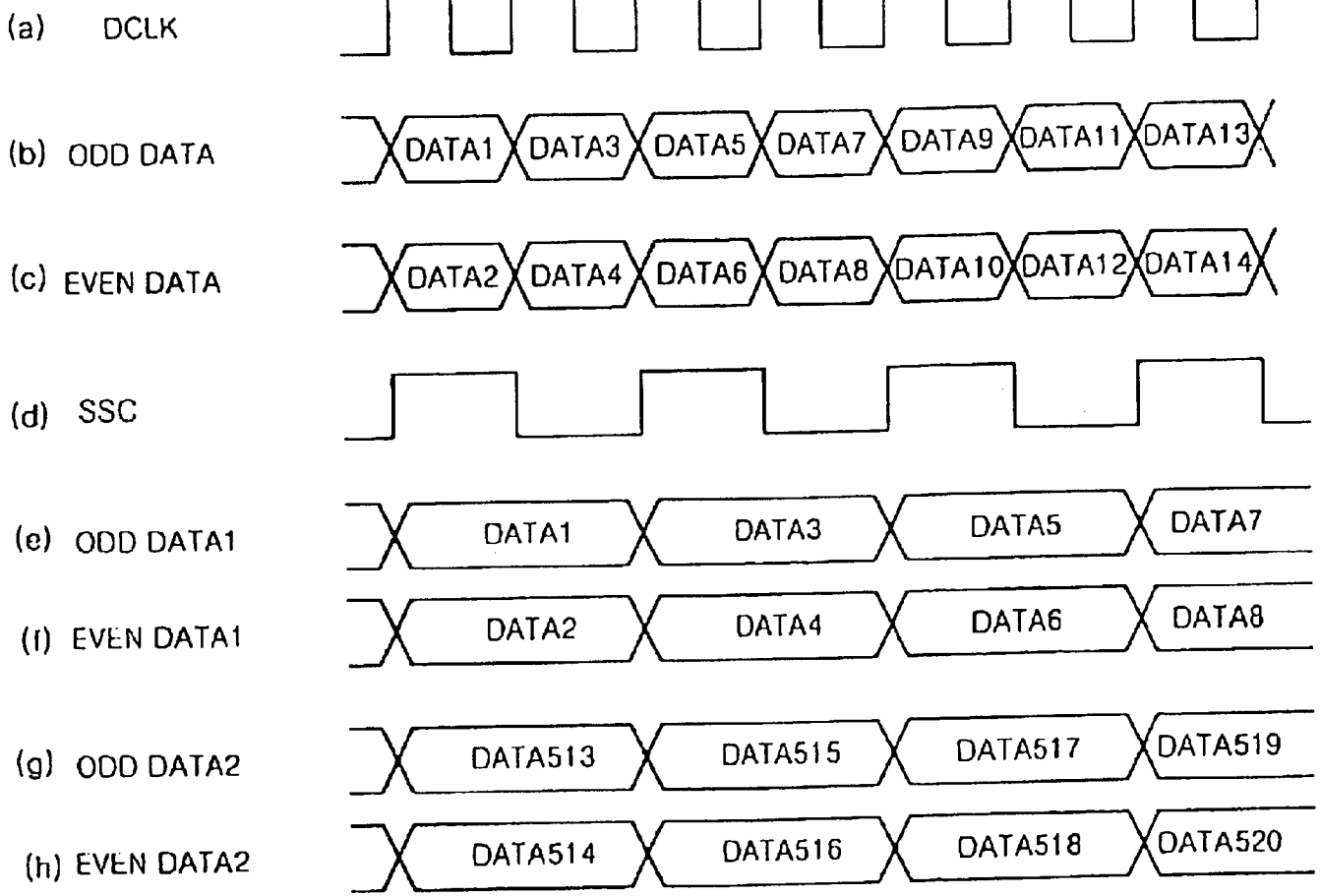
FIG.3 PRIOR ART
FIG. 3 is an operational timing chart according to the conventional four-port data transmission method.
Figure 4:
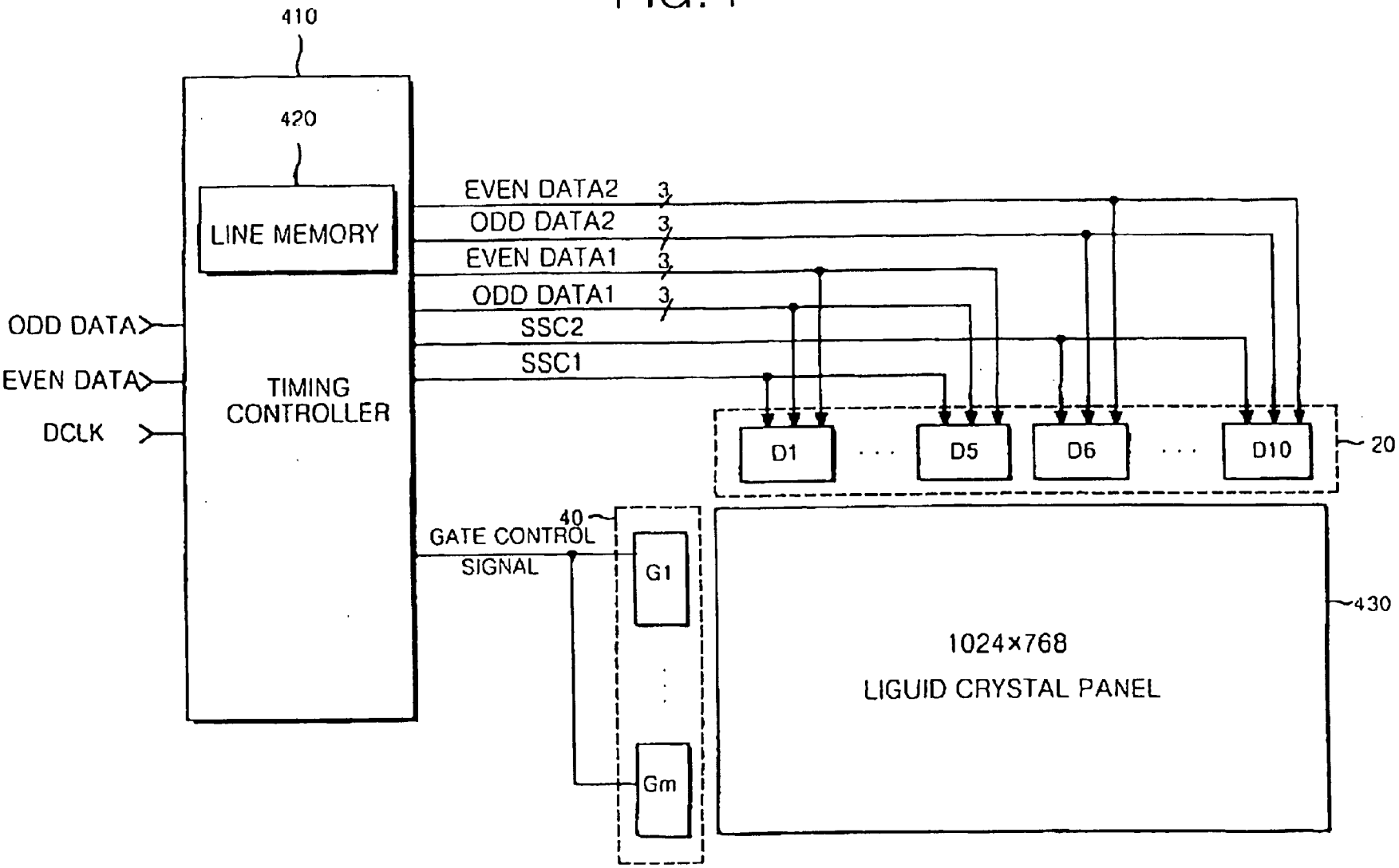
FIG. 4 is a block diagram showing a configuration of a liquid crystal display device according to an embodiment of the present invention.
Figure 5:
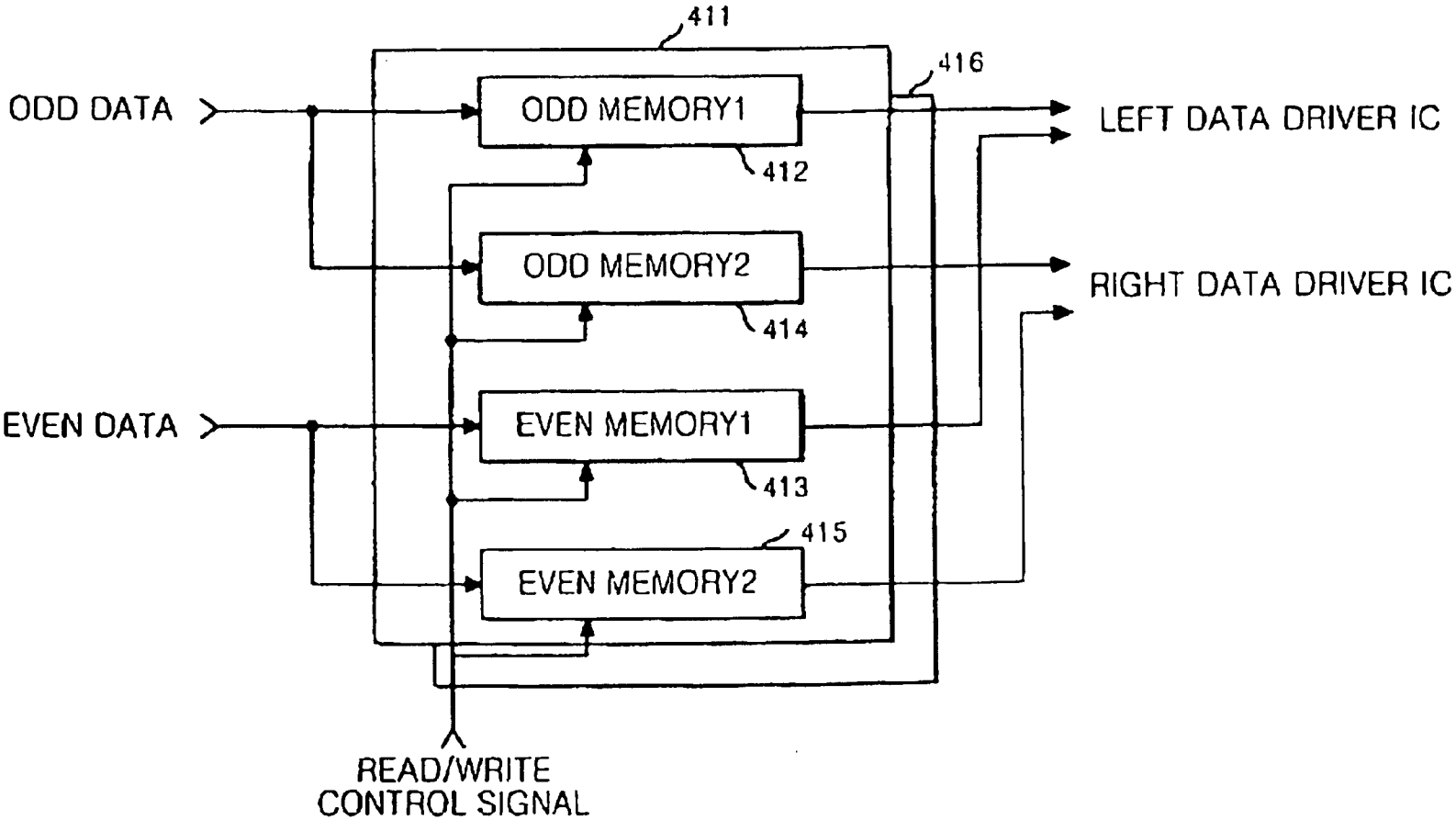
FIG. 5 is a block diagram showing a configuration of the line memory integrated to the timing controller in FIG. 4.

Referring to FIG. 4, there is shown a liquid crystal display (LCD) according to an embodiment of the present invention. In FIG. 4, a timing controller 410 stores odd and even data inputted from an interface (not shown) in a line memory 420. The line memory 420 consists of a first line memory block 411 and a second line memory block 416 as shown in FIG. 5. Assuming that a liquid crystal display panel 430 has been divided into left and right areas, the first line memory 411 includes a first odd memory block 412 for storing odd-numbered data in 1st to 512th pixels, a first even memory block 413 for storing even-numbered data in 1st to 512th pixels, a second odd memory block 414 for storing odd-numbered data in 513th to 1024th pixels, and a second even memory block 415 for storing even-numbered data in 513th to 1024th pixels. The second line memory block 416 has a configuration similar to the first line memory block 411.

Figure 6:
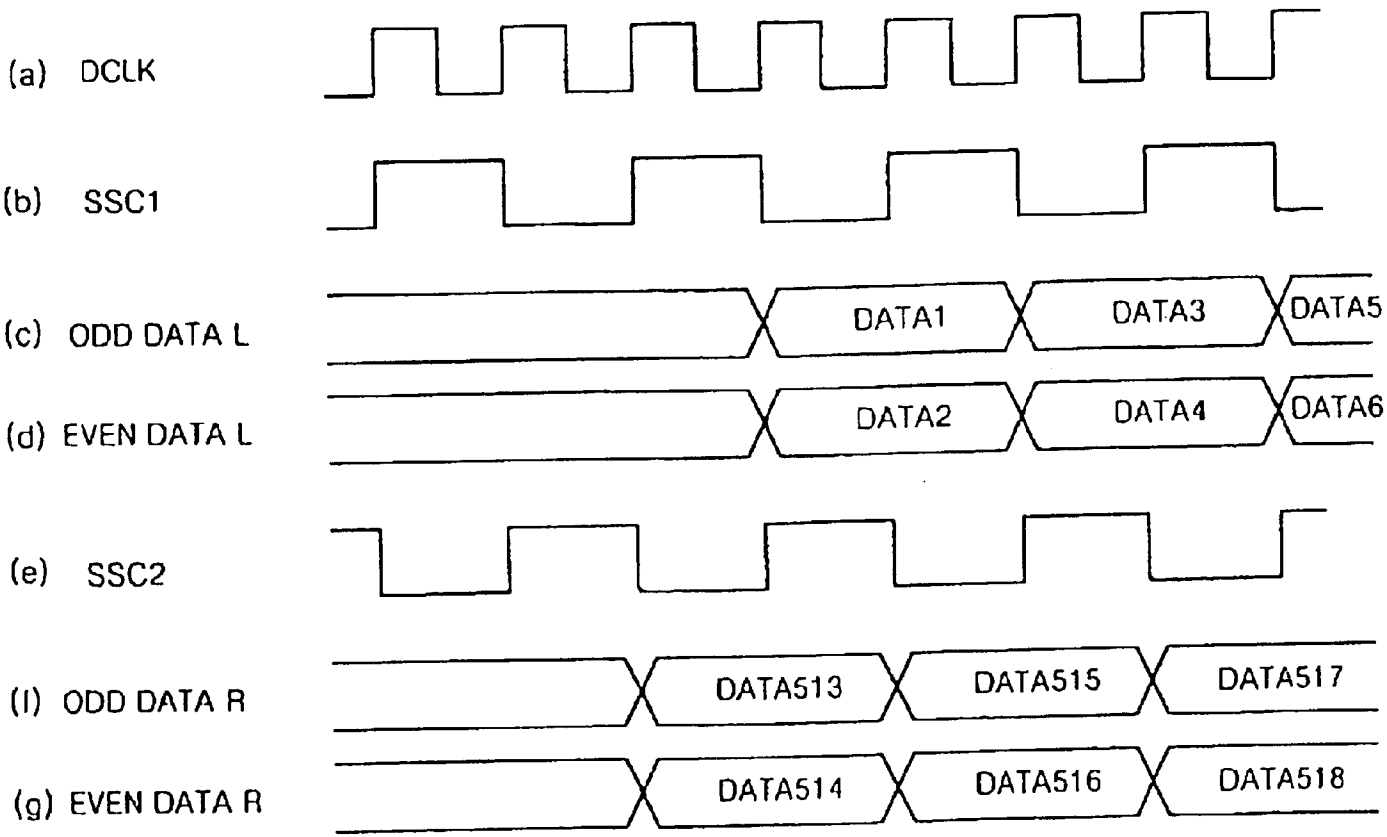
FIG. 6 is waveform diagrams for showing an operation timing according to an embodiment of the present invention.

The first line memory block 411 divides data for one horizontal line into left and right areas in response to a read/write control signal of the timing controller 410 to store the same in the first odd and even memory blocks 412 and 413 and the second memory blocks 414 and 415, respectively. When the data storage in the first line memory block 411 has been completed, the next line data is divided into left and right areas and stored in the second line memory block 416. When the second memory block 416 is storing the data, the timing controller 410 is synchronized with the falling edge of a second source sampling clock SSC2 shown in (e) of FIG. 6 from the first line memory block 411 to output the odd and even data 513 and 514 shown in (f) and (g) of FIG. 6 from the second odd and even memory blocks 414 and 415, respectively, to a right data driver IC group D6 to D10. Then, the timing controller 410 is synchronized with the falling edge of a first source sampling clock SSC1 shown in (b) of FIG. 6 from the first line memory block 411 to sequentially output the odd and even data 1 and 2 shown in (c) and (d) of FIG. 6 from the first odd and even memory blocks 412 and 413, respectively, to a left data driver IC group D1 to D5. In other words, two pixel data are alternately synchronized with the first source sampling clock SSC1 and the second sampling clock SSC2, respectively, and are outputted from the first odd and even memory blocks 412 and 413 and the second odd and even memory blocks 414 and 415 at a timing having a difference of ½ period from each other. At this time, the first and second source sampling clocks SSC1 and SSC2 have a frequency frequency-divided twice from a data clock DCLK shown (a) of FIG. 6.

Consequently, the timing controller 410 has a frequency reduced to ½ in comparison to that of the input data clock, generates the first and second source sampling clocks SSC1 and SSC2 having a phase contrary to each other. The timing controller 410 is synchronized with the first and second source sampling clocks SSC1 and SSC2 to sequentially output four pixel data to the left and right data driver IC groups connected to the left and right areas of the liquid crystal panel at a time difference of ½ period for each of the two pixel data.

Accordingly, the LCD according to an embodiment of the present invention drives the data driver IC's at a clock having a frequency reduced to ½ in comparison to that of the input data clock. Since the timing controller 410 outputs only each of the two pixel data simultaneously, it can not only reduce a driving frequency, but also restrain a generation of a transient current caused by a lot of data outputs. In other words, the LCD according to the present invention reduces a driving frequency using the four-port driving method to output only 48 bits which is equal to a half of 96 bit outputs in the prior art, so that it can restrain a generation of transient current.

In the above-mentioned embodiment of the present invention, the right data is outputted earlier, but the left data may be outputted earlier. Also, the first source sampling clock SS1 and the second source sampling clock SS2 has a delay time of ½ period from each other, but may have a delay time of ¼, ¾ and so on. Further, FIG. 4 to FIG. 6 have illustrated the four-port driving method reducing an operation frequency to ½ as an example, but it is possible to divide the liquid crystal panel into four areas and output the 8 pixels for each of four pixel data at a time difference of ½ period or output the 8 pixels for each of two pixel data at a time difference of ¼ period so as to reduce an operation frequency to ¼ as another embodiment. The embodiment described in FIG. 4 to FIG. 6 divides the liquid crystal panel into the left and right areas, it is possible to divide the data driver IC's into the odd and even groups D1, D3, . . . , D9 and D2, D4, . . . , D10. In addition, it is possible to divide the data lines into groups of even and odd numbers, etc. by arranging the data driver IC's at the upper and lower portions of the panel.

Moreover, the present invention is applicable to a case where it is not intended to reduce a driving frequency. Such another embodiment of the present invention will be described in detail with reference to FIG. 7.

Figure 7:
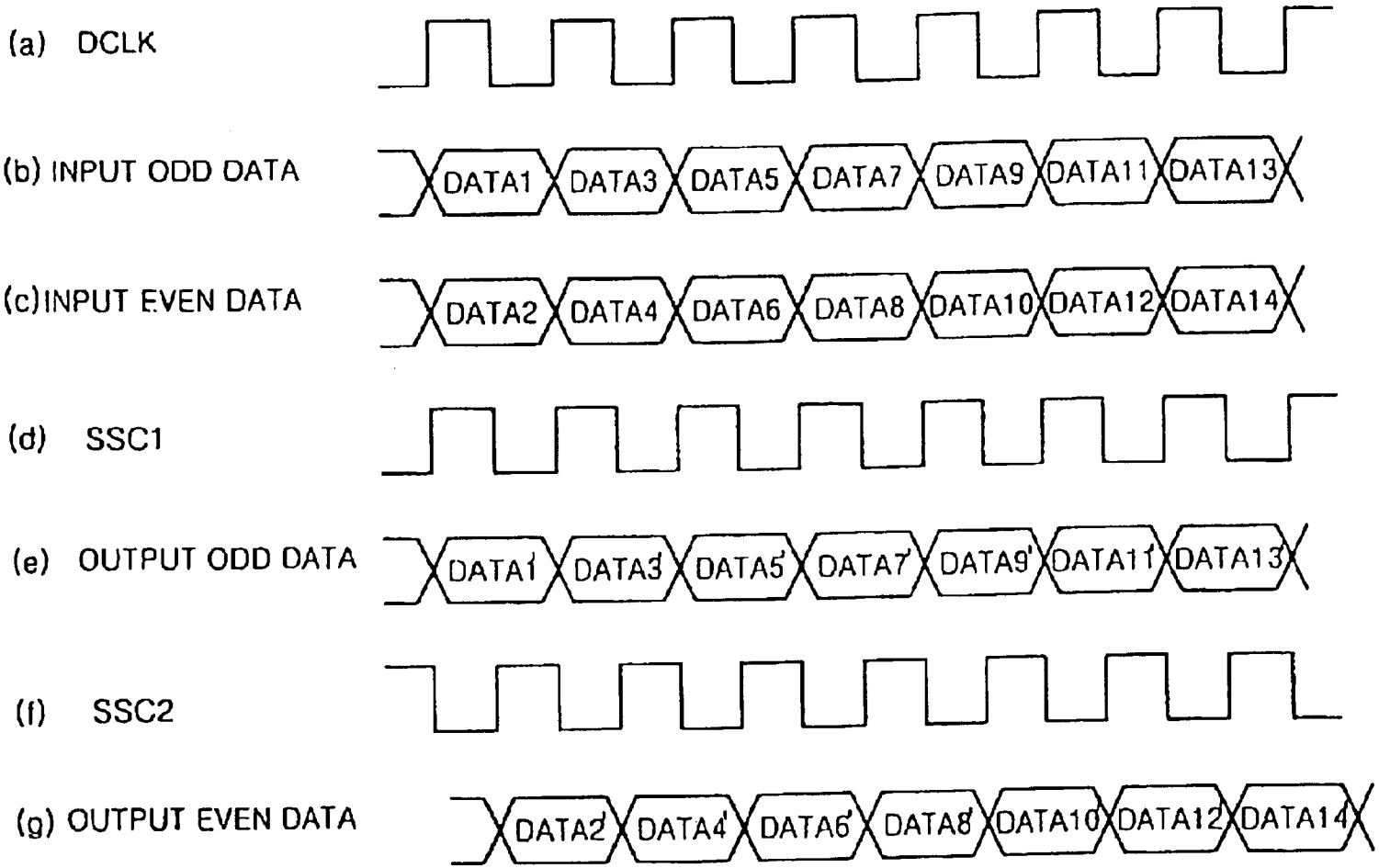
FIG. 7 is waveform diagrams for showing an operation timing according to another embodiment of the present invention.

In FIG. 7, a data clock DCLK ((a) of FIG. 7), a first sampling clock SSC1 ((d) of FIG. 7) and a second source sampling clock SSC2 ((f) of FIG. 7) has an equal frequency from each other. Also, a transfer rate of an input data is equal to that of an output data. First, the timing controller 410 generates the first source sampling clock SSC1 and the second source sampling clock SSC2 that have a frequency identical to the input data clock DCLK and a phase contrary to each other. Then, the timing controller 410 receives odd data d2*n*-1 ((b) of FIG. 7) and even data D2*n* ((c) of FIG. 7) at two ports. The timing controller 410 is synchronized with the rising edge of the first sampling clock SSC1 to output even data D2*n*-1 ((e) of FIG. 7). Also, the timing controller 410 is synchronized with the rising edge of the second sampling clock SSC2 to output even data D2*n* ((g) of FIG. 7) at a time difference of a ½ period in the data clock DCLK from an output time of the odd data D2*n*-1 shown in (e) of FIG. 7. According to the above-mentioned driving method, the line memory 420 for two lines is not required within the timing controller 410, but a latch circuit for latching at least two pixels only is required. As a result, the above-mentioned another embodiment of the present invention uses the two-port driving method, but can output only each of 24 bits simultaneously.

As described above, according to the present invention, the driving frequency and the simultaneously outputted data amount are reduced to restrain a generation of transient current. Also, the simultaneously outputted data amount is reduced in spite of using the same driving frequency to restrain a generation of transient current. Accordingly, a capacitor configuration for eliminating a transient current can be omitted to reduce a manufacturing cost.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a line memory for dividing a data for at least one line inputted from the exterior thereof into a plurality of groups to store the divided data therein and for outputting the data at a desired unit from each of the groups;

a driving circuit including n driver integrated circuits (wherein n is an integer) that are connected to the line memory and a liquid crystal display panel to drive the liquid crystal display panel in response to the data outputted from the line memory; and a timing controller, being connected to the line memory and the driving circuit, for receiving a data clock inputted from the exterior thereof to alternately output the data from the plurality of groups in said line memory to the driving circuit every period of the data clock in response to a time corresponding to the number of said groups.

2. The liquid crystal display device as claimed in claim 1, wherein the plurality of groups consist of a first group and a second group including data inputted to 1 st to (n/2)th driver integrated circuits and to ((n+1)/2)th to nth driver integrated circuits, respectively.

3. The liquid crystal display device as claimed in claim 2, wherein the timing controller generates an inverted data clock having a phase contrary to the input data clock and outputs a data from the first group of the line memory in response to the input data clock while outputting a data from the second memory group of the line memory in response to the inverted data clock, thereby outputting the data in the first group and the data in the second group to the driving circuit at a different time during each period of the input data clock.

4. The liquid crystal display device as claimed in claim 1, wherein the plurality of groups consist of a first group and a second group including data inputted to odd-numbered driver integrated circuits and even-numbered driver integrated circuits in the driving circuit connected to the liquid crystal display panel, respectively.

5. The liquid crystal display device as claimed in claim 4, wherein the timing controller generates an inverted data clock having a phase contrary to the input data clock and outputs a data from the first group of the line memory in response to the input data clock while outputting a data from the second memory group of the line memory in response to the inverted data clock, thereby outputting the data in the first group and the data in the second group to the driving circuit at a different time during each period of the input data clock.

6. The liquid crystal display device as claimed in claim 1, wherein the plurality of groups consist of a first group and a second group including data inputted to upper driver integrated circuits and lower driver integrated circuits in the driving circuit connected to the upper and lower sides of the liquid crystal display panel, respectively.

7. The liquid crystal display device as claimed in claim 6, wherein the timing controller generates an inverted data clock having a phase contrary to the input data clock and outputs a data from the first group of the line memory in response to the input data clock while outputting a data from the second memory group of the line memory in response to the inverted data clock, thereby outputting the data in the first group and the data in the second group to the driving circuit at a different time during each period of the input data clock.

8. A liquid crystal display device, comprising:

a line memory for dividing a data for at least one line inputted from the exterior thereof into a plurality of groups to store the divided data therein and for outputting the data at a desired unit from each of the groups;

a driving circuit including n driver integrated circuits (wherein n is an integer) that are connected to the line memory and a liquid crystal display panel to drive the liquid crystal display panel in response to the data outputted from the line memory; and a timing controller, being connected to the line memory and the driving circuit, for receiving a data clock inputted from the exterior thereof to generate a first data clock by frequency-dividing the input data clock at a frequency-division ratio corresponding to the number of said divided groups, and for alternately outputting the data in each of the groups to the driving circuit during each period of the input data clock.

9. The liquid crystal display device as claimed in claim 8, wherein the plurality of groups consist of a first group and a second group including data to be displayed on the liquid crystal display panel connected to 1st to (n/2)th driver integrated circuits and to ((n+1)/2)th to nth driver integrated circuits, respectively.

10. The liquid crystal display device as claimed in claim 9, wherein the timing controller generates an inverted data clock having a phase contrary to the frequency-divided data clock and outputs a data from the first group of the line memory in response to the frequency-divided data clock while outputting a data from the second memory group of the line memory in response to the inverted data clock, thereby outputting the data in the first group and the data in the second group to the driving circuit at a different time during each period of the input data clock.

11. The liquid crystal display device as claimed in claim 8, wherein the plurality of groups consist of a first group and a second group including data inputted to odd-numbered driver integrated circuits and even-numbered driver integrated circuits in the driving circuit connected to the liquid crystal display panel, respectively.

12. The liquid crystal display device as claimed in claim 11, wherein the timing controller generates an inverted data clock having a phase contrary to the input data clock and outputs a data from the first group of the line memory in response to the input data clock while outputting a data from the second memory group of the line memory in response to the inverted data clock, thereby outputting the data in the first group and the data in the second group to the driving circuit at a different time during each period of the input data clock.

13. A liquid crystal display device, comprising:

a line memory for receiving two pixel data unit sequentially from the exterior thereof and dividing the data for at least one line into a plurality of groups to store the divided data therein and for outputting the two pixel data unit from each of the groups;

a driving circuit including n driver integrated circuits (wherein n is an integer) that are connected to the line memory and a liquid crystal display panel to drive the liquid crystal display panel in response to the data outputted from the line memory; and a timing controller, being connected to the line memory and the driving circuit, for receiving a data clock inputted from the exterior thereof to generate a first data clock by frequency-dividing the input data clock at a frequency-division ratio corresponding to the number of said divided groups, and for alternately outputting the two pixel data in each of the groups to the driving circuit during each period of the input data clock.

14. The liquid crystal display device as claimed in claim 13, wherein the plurality of groups consist of a first group and a second group including data to be displayed on two divisional area divided into the left and right sides of the liquid crystal display panel, respectively.

15. The liquid crystal display device as claimed in claim 14, wherein the timing controller generates a second data clock having a phase contrary to the first data clock and outputs two pixel data from the first group of the line memory in response to the first data clock while outputting two pixel data from the second memory group of the line memory in response to the second data clock, thereby supplying the two pixel data unit from the first group and the second group of the line memory to the driving circuit at a different time interval during each period of the input data clock.

16. The liquid crystal display device as claimed in claim 13, wherein the plurality of groups consist of a first group and a second group including data inputted to odd-numbered driver integrated circuits and even-numbered driver integrated circuits in the driving circuit connected to the liquid crystal display panel, respectively.

17. The liquid crystal display device as claimed in claim 16, wherein the timing controller generates a second data clock having a phase contrary to the first data clock and outputs two pixel data from the first group of the line memory in response to the first data clock while outputting two pixel data from the second memory group of the line memory in response to the second data clock, thereby supplying the two pixel data unit from the first group and the second group of the line memory to the driving circuit at a different time interval during each period of the input data clock.

18. A liquid crystal display device, comprising:

a latch circuit for latching and outputting two pixel units inputted from the exterior thereof;

a driving circuit including n driver integrated circuits (wherein n is an integer) that are connected to the latch circuit and a liquid crystal display panel to drive the liquid crystal display panel in response to the data outputted from the latch; and a timing controller, being connected to the latch circuit and the driving circuit, for receiving a data clock inputted from the exterior thereof to alternatively output each one of the two pixel units to the driving circuit at a desired time interval during one period of the data clock.

19. The liquid crystal display device as claimed in claim 18, wherein the timing controller generates an inverted data clock having a phase contrary to the input data clock and outputs odd pixel data from the latch circuit in response to the input data clock while outputting even pixel data from the latch circuit in response to the inverted data clock, thereby supplying the odd and even data from the latch circuit to the driving circuit at a desired time interval during each period of the input data clock.

20. A method of driving a liquid crystal display device, comprising:

a data storage step of dividing and storing an input data for at least one line a plurality of groups;

a data clock generating step of frequency-dividing an input first data clock at a frequency-division ratio corresponding to the number of said divided groups to generate a second data clock;

a data outputting step of alternately outputting a desired data unit from each of said groups at a different time during one period of the second data clock; and a displaying step of latching the output data for one line unit to drive a liquid crystal display panel in response to the latched data.

21. The method as claimed in claim 20, wherein the data storage step includes sequentially receiving at least two pixel data to divide and store the data for one line into two groups; the frequency division ratio at the data clock generating step is two; and the two groups at the data storage step individually output the two pixel data at a desired time difference during one period of the second data clock.

22. A method of driving a liquid crystal display panel having a plurality of pixels and a plurality of driving integrated circuits, comprising:

receiving, at a timing controller, an externally applied data clock signal;

receiving, at the timing controller, first and second data groups corresponding to predetermined groups of pixels; and alternately outputting, from the timing controller to the plurality of driving integrated circuits, the first and second data groups during one period of the received data clock signal.

23. The method of driving a liquid crystal display panel according to claim 22, further comprising:

generating a first source sampling clock signal; and generating a second source sampling clock signal, wherein a phase of the second source sampling signal is different from a phase of the first source sampling signal, wherein the first data group is output to a first group of the plurality of driving integrated circuits according to the first source sampling clock signal, and wherein the second data group is output to a second group of the plurality of driving integrated circuits according to the second source sampling clock signal.

24. The method of driving a liquid crystal display panel according to claim 23, wherein a frequency of the first source sampling clock signal is equal to a frequency of the second source sampling clock signal.

25. The method of driving a liquid crystal display panel according to claim 23, wherein a frequency of the first and second source sampling clock signals is equal to a frequency of the received data clock signal.

26. The method of driving a liquid crystal display panel according to claim 23, wherein a frequency of the first and second source sampling clock signals is different from a frequency of the received data clock signal.

27. The method of driving a liquid crystal display panel according to claim 26, wherein a frequency of the first and second sampling clock signals is less than a frequency of the received data clock signal.

28. The method of driving a liquid crystal display panel according to claim 23, wherein generating the first and second source sampling clock signals includes frequency-dividing the received data clock signal.

29. The method of driving a liquid crystal display panel according to claim 23, wherein the phase of the second source sampling signal is opposite to the phase of the first source sampling signal.

30. The method of driving a liquid crystal display panel according to claim 23, wherein the phase of the second source sampling signal is shifted by V4 of a period of the first source sampling signal.

31. The method of driving a liquid crystal display panel according to claim 23, wherein the phase of the second source sampling signal is shifted by ¾ of a period of the first source sampling signal.

32. The method of driving a liquid crystal display panel according to claim 23, wherein the phase of the second source sampling signal is shifted by ¾ of a period of the first source sampling signal.

* * * * *